US008643590B2

(12) United States Patent
Kerofsky et al.

(10) Patent No.: US 8,643,590 B2
(45) Date of Patent: Feb. 4, 2014

(54) AMBIENT ADAPTIVE ILLUMINATION OF A LIQUID CRYSTAL DISPLAY

(75) Inventors: Louis Joseph Kerofsky, Camas, WA (US); Xinyu Xu, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 518 days.

(21) Appl. No.: 12/975,895

(22) Filed: Dec. 22, 2010

(65) Prior Publication Data

US 2012/0162245 A1 Jun. 28, 2012

(51) Int. Cl.
*G09G 3/36* (2006.01)

(52) U.S. Cl.
USPC ..... 345/102; 345/89; 345/690; 348/672

(58) Field of Classification Search
USPC ..... 345/87–89, 102, 207, 690, 596; 348/672–675, 678, 679, 687
See application file for complete search history.

(56) References Cited

U.S. PATENT DOCUMENTS

| | | | | |
|---|---|---|---|---|
| 7,301,545 | B2 | 11/2007 | Park et al. | |
| 7,352,410 | B2 | 4/2008 | Chou | |
| 7,501,771 | B2 | 3/2009 | Kawano | |
| 7,504,612 | B2 * | 3/2009 | Yu et al. | 250/206 |
| 7,573,533 | B2 | 8/2009 | Moldvai | |
| 7,746,317 | B2 | 6/2010 | Fu et al. | |
| 8,223,117 | B2 * | 7/2012 | Ferguson | 345/102 |
| 2005/0190142 | A1 * | 9/2005 | Ferguson | 345/102 |
| 2005/0212824 | A1 | 9/2005 | Marchinkiewicz et al. | |
| 2007/0236438 | A1 * | 10/2007 | Sung | 345/88 |
| 2009/0161020 | A1 | 6/2009 | Barnhoefer et al. | |
| 2010/0039414 | A1 | 2/2010 | Bell | |
| 2011/0012937 | A1 * | 1/2011 | Onishi et al. | 345/690 |

FOREIGN PATENT DOCUMENTS

| | | | |
|---|---|---|---|
| JP | 63-38989 | A | 2/1988 |
| JP | 05-094156 | A | 4/1993 |
| JP | 06-331962 | A | 12/1994 |
| JP | 2004-325748 | A | 11/2004 |

OTHER PUBLICATIONS

International Search Report, dated Dec. 13, 2011, in International App. No. PCT/JP2011/075649, filed Nov. 1, 2011 by Sharp Kabushiki Kaisha, 7 pgs.

* cited by examiner

*Primary Examiner* — Kimnhung Nguyen
(74) *Attorney, Agent, or Firm* — Chernoff Vilhauer McClung & Stenzel, LLP

(57) ABSTRACT

A system for modification of an image to be displayed on a display includes receiving an input image and adjusting a luminance level for a backlight of the display for displaying the input image based upon an ambient lighting level and a visual system responsive model to the ambient lightening level.

18 Claims, 9 Drawing Sheets

FIG. 2 VISUAL RESPONSE ADAPTATION

FIG. 3 BRIGHTENING FACTOR VERSUS AMBIENT LIGHT LEVEL

FIG. 4 CANDIDATE BRIGHTENING TONESCALES

FIG. 5 SLOPE OF CANDIDATE TONECURVE

FIG. 6 ERROR VECTORS

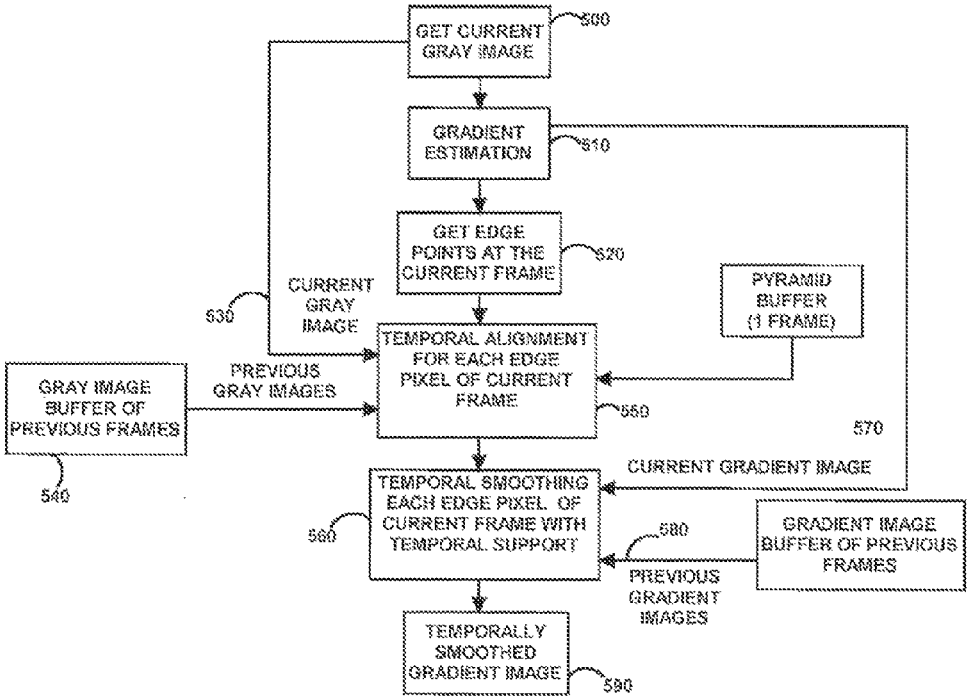
FIG. 8 TEMPORAL EDGE FLICKERING REDUCTION FOR VIDEO- KFH

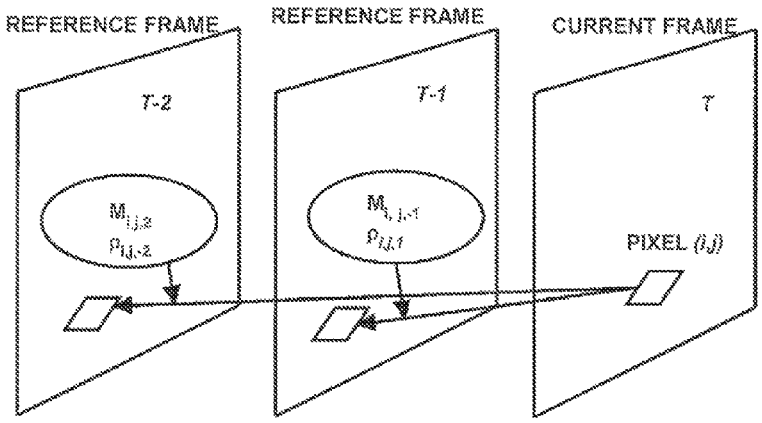
FIG. 9 FIND TEMPORAL CORRESPONDENCES WITH MOTION ESTIMATION.

AMBIENT ADAPTIVE ILLUMINATION OF A LIQUID CRYSTAL DISPLAY

CROSS-REFERENCE TO RELATED APPLICATIONS

Not applicable.

BACKGROUND OF THE INVENTION

The present invention relates generally to selecting a suitable brightness for a liquid crystal display.

Relatively low-contrast viewing conditions tend to negatively impact the viewing experience of a viewer of an liquid crystal display device. Examples of liquid crystal display devices include, for example, a LCD television, a LCD monitor, a LCD mobile device, among other devices including a liquid crystal display. The negative impacts for the viewer may include, for example, eyestrain and fatigue.

Low-contrast viewing conditions tend to arise when a device is used in an aggressive power-reduction mode, where the backlight power level of the liquid crystal device (and thus the illumination provided by the backlight) is significantly reduced making the image content (e.g., still image content and video image content) appears generally dark and the details of which are difficult to determine by the viewer. The contrast of the image content may be vastly reduced, or in some cases, pegged at black, resulting in many image features to fall below the visible threshold.

Low-contrast viewing conditions tend to also arise when an LCD display is viewed under high ambient light, for example, direct sunlight. In these situations, the minimum display brightness that a viewer may perceive may be elevated due to the high ambient light in the surroundings. The image content may appear "washed out" where it is intended to be bright, and the image content may appear generally featureless in darker regions of the image.

For either of the above-described low-contrast viewing conditions, and other low-contrast viewing conditions, the tonal dynamic range of the image content tends to be compressed and the image contrast is substantially reduced, thereby degrading the viewing experience of the user. Due to increasing consumer concern for reduced energy costs and demand for device mobility, it may be desirable to provide improved image content to enhance the viewing experience under low-contrast viewing conditions.

What is desired is a display system that provides a suitable enhancement for a particular image.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

FIG. 8 illustrates temporal edge flickering reduction.

FIG. 9 illustrates temporal correspondence with motion estimation.

DETAILED DESCRIPTION OF PREFERRED EMBODIMENT

Figure 1:
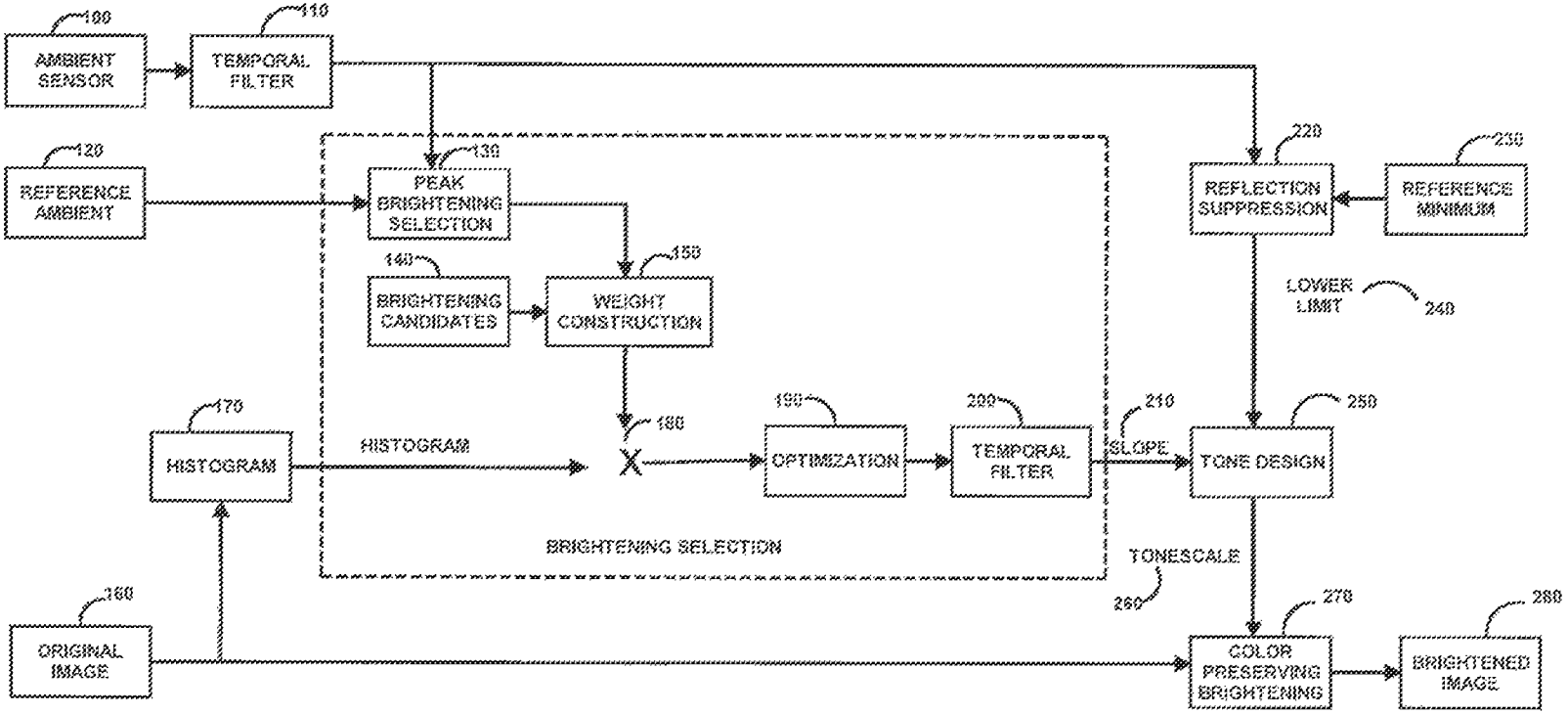
FIG. 1 illustrates a system for ambient and content adaptive brightening control.

Referring to FIG. 1, to appropriately select a luminance level for the backlight of a liquid crystal display, the display includes an ambient sensor 100 that senses the ambient light level of the environment of the display. Alternatively, the viewer may indicate the ambient light level, such as for example, high, medium high, medium, medium low, and low. In either case, the display determines a signal indicative of the ambient lighting level. Typically the signal will tend to vary somewhat over time, and it is desirable that the brightness level of the display is not varied as often, therefore the signal indicative of the ambient lighting levels is temporally filtered 110 to smooth out the signal.

A reference ambient value 120 is predetermined by the display or otherwise selected by the user based upon their preferences. The reference ambient value 120 provides a value to compare against the signal indicative of the ambient lighting level. A peak brightening selection 130 compares the reference ambient value 120 to the signal indicative of the ambient lighting level to determine the strength of the ambient lighting. For example, if the reference ambient value 120 is greater than the signal indicative of the ambient lighting level then the lighting conditions are generally dim. For example, if the reference ambient value 120 is less than the signal indicative of the ambient lighting level then the lighting conditions are generally bright. The magnitude of the difference between the signals provides an indication of the amount of brightness change of the backlight of the liquid crystal display for a suitable viewing condition.

The display includes a set of brightening candidates 140. The brightening candidates preferably includes a set of different functions that may be applied to the image content. The brightening candidates may be in any suitable form, such as a single function, a plurality of functions, or a look up table. Based upon the peak brightening selection 130 and the brightening candidates 140 a set of weight functions 150 are constructed. The weight construction 150 determines a set of errors, typically a set of errors is determined for each of the brightness candidates. For example, an error measure may be determined for each pixel of the image that is above the maximum brightness of the display for each of the brightness candidates 140.

An input image content 160 is received by the display. A histogram 170, or any other characteristics of the image content, is determined based upon the image content. 160. Each of the calculated weights 150 is separately applied 180 to the histogram 170 to determine a resulting error measure with respect to the particular input image. Since each input image (or series of images) 160 is different, the results of the weight construction, even for the same ambient brightness level, will be different. The lowest resulting error measure from the weight construction 150 and the histogram 170 is selected by an optimization process 190. A temporal filter 200 may be applied to the optimization process 190 to smooth out the results in time to reduce variability.

The output of the temporal filter 200 is a slope 210 which is representative of a scale factor, a curve, a graph, a function (s), or otherwise which should be applied to the input image 160 to brighten (or reduce) the image, for the particular ambient lighting conditions. In addition, a reflection suppression 220 based upon a reference minimum 230, may be applied to the temporally filtered 110 output of the ambient light sensor 100. This provides a lower limit 240 for the image.

A tone design 250 receives the slope 210, together with the lower limit 240, and determines a corresponding tone scale 260. The tone scale 260 is applied to the original image 160 by a color persevering brightening process 270. In this manner, based upon the ambient lighting conditions and the particular image content, the system determines a suitably brightened image 280.

An exemplary set of equations and graphs are described below to further illustrate an exemplary technique previously described. The ambient sensor 100 may use a model that is adaptive to the visual response of the human visual system, such as shown by equation 1.

$$\text{Response} = \frac{Y^n}{Y^n + \sigma^n}\sigma = I_A^{\alpha} \cdot \beta. \qquad \text{Equation 1}$$

Figure 2:
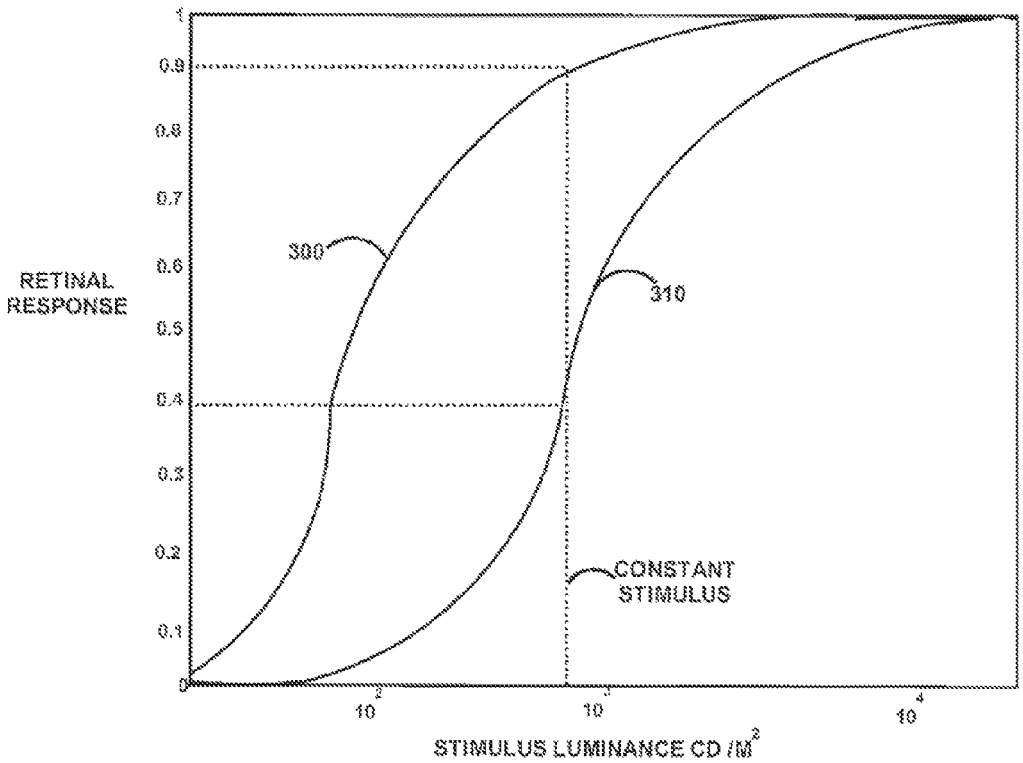
FIG. 2 illustrates visual response adaptation.

The response to an input stimulus Y at two different ambient light levels may be represented as shown in FIG. 2. FIG. 2 illustrates that a single input stimulus level will result in different responses at different ambient light levels. The curve 300 represents low lighting levels such as 200 cd/m$^2$, while the curve 310 represents high lightening values such as 2000 cd/m$^2$. Accordingly, this illustrates that for the same stimulus luminance, the retinal response of the viewer is different based upon the ambient light level.

Analysis shows the adaptation model used above predicts the retinal response is a function of the ratio of stimulus luminance and the ratio of ambient level to a reference ambient light level.

$$\text{Response} = \frac{\left(\frac{Y}{I_A^{\alpha}}\right)^n}{\left(\frac{Y}{I_A^{\alpha}}\right)^n + (\beta)^n}$$

$$\text{Response}\left(Y, \frac{I_A}{I_{ref}}\right) = \frac{\left(Y \cdot \left(\frac{I_{ref}}{I_A}\right)^{\alpha}\right)^n}{\left(Y \cdot \left(\frac{I_{ref}}{I_A}\right)^{\alpha}\right)^n + ((I_{ref})^{\alpha} \cdot \beta)^n}$$

$$\text{Response}(Y, r) = \frac{\left(\frac{Y}{r^{\alpha}}\right)^n}{\left(\frac{Y}{r^{\alpha}}\right)^n + ((I_{ref})^{\alpha} \cdot \beta)^n}$$

Figure 3:
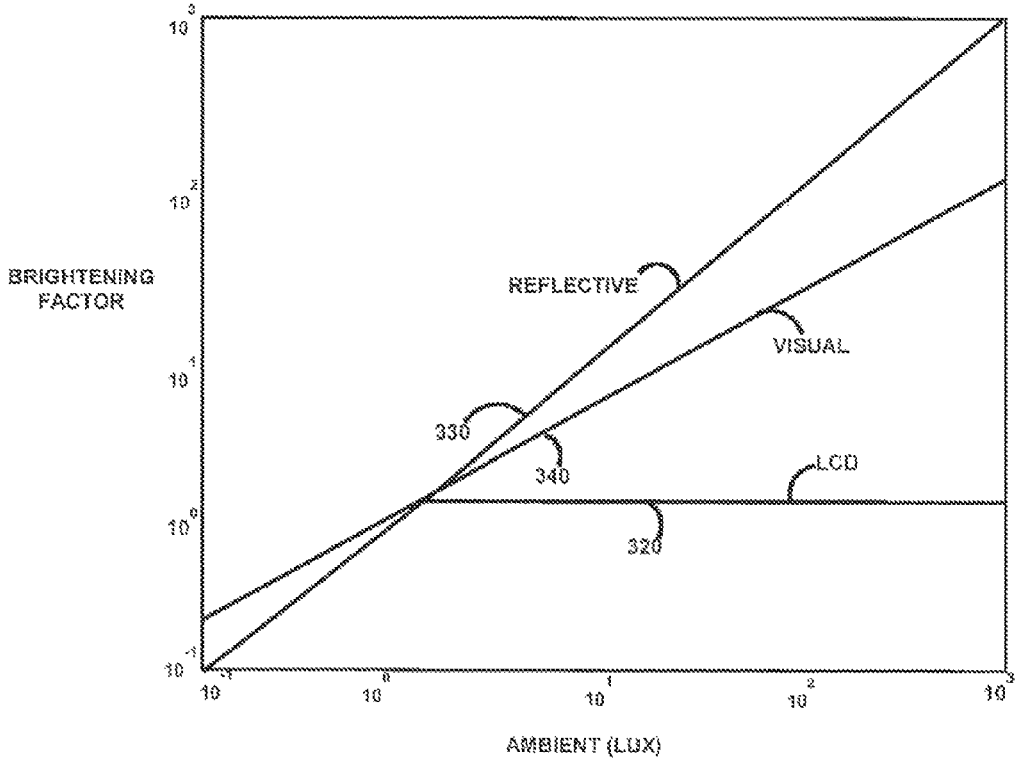
FIG. 3 illustrates brightening factor versus ambient light level.

The response depends on the ratio of the stimulus luminance and a power of the relative ambient level. As a consequence, the response will remain constant when the relative ambient level changes if the stimulus is brightened accordingly. A visual model based ambient adaptation may be used where the image is brightened in accordance with a visual adaptation model. Three examples of brightness versus ambient light level are shown in FIG. 3. FIG. 3 assumes all three displays have equal brightness at a reference ambient light level. Curve 320 illustrates a LCD curve where the display clips the maximum value. Curve 330 illustrates a reflective display curve that has a unity response. Curve 340 illustrates a curve based upon a visual model of the viewer.

Figure 4:
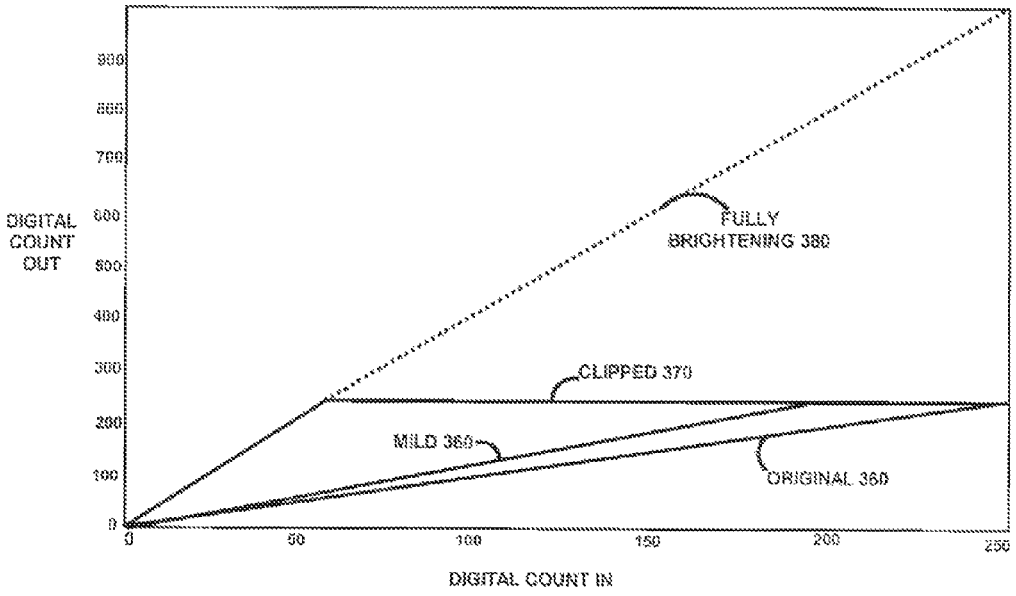
FIG. 4 illustrates candidate brightening tonescales.

Brightening is achieved by tonescale operation applied to the image prior to being displayed. In general, given a desired brightening level, a full brightening tonescale can be developed which is limited by the LCD output. A set of candidate tone scales may consist of a linear brightening with clipping at the display maximum as illustrated in FIG. 4. An original brightening curve 350 is a straight line. A mild brightening curve 360 includes limited clipping. A strong clipped brightening curve 370 includes more substantial clipping. A full brightening curve 380 is determined from the ambient light level as described above from an adaptation model.

A content dependant measure may be used to select from among the candidate brightening tonescales. One metric is based on the contrast achieved by the candidate tonescale and the contrast achieved by the full brightening tonescale.

Figure 5:
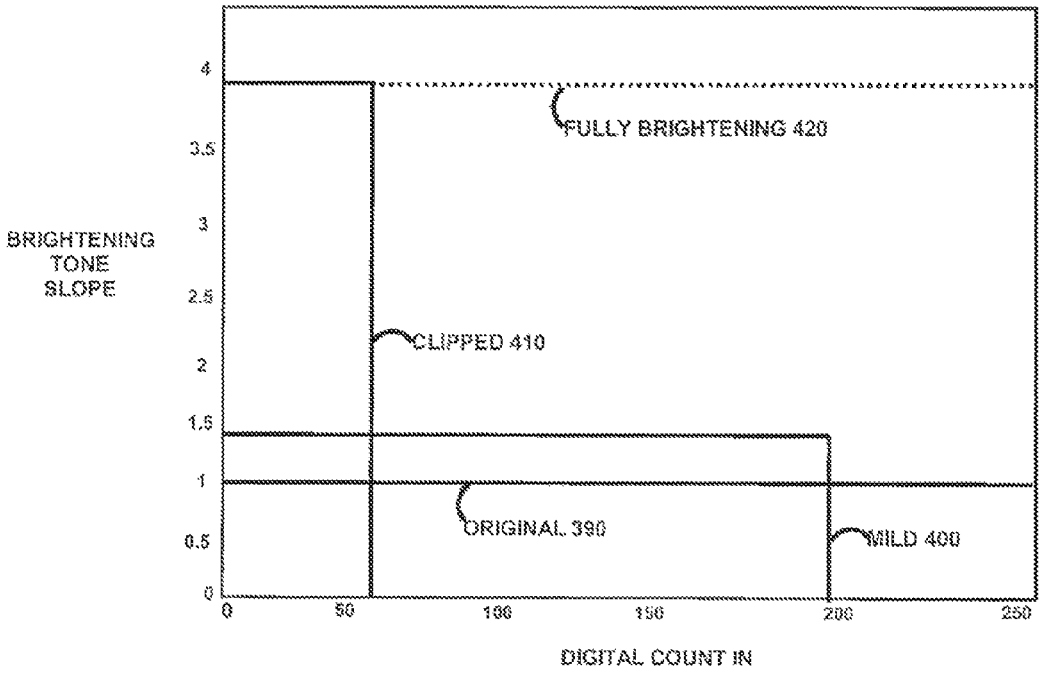
FIG. 5 illustrates slope of candidate tonecurves.

The slope of each candidate tonescale may be computed, for example, as illustrated in FIG. 5. An original slope of the candidate tonecurve is illustrated by curve 390. A mild slope of the candidate tonecurve is illustrates by curve 400. A strong clipped candidate tonecurve is illustrated by curve 410. A fully brightening candidate tonecurve is illustrated by curve 420.

Figure 6:
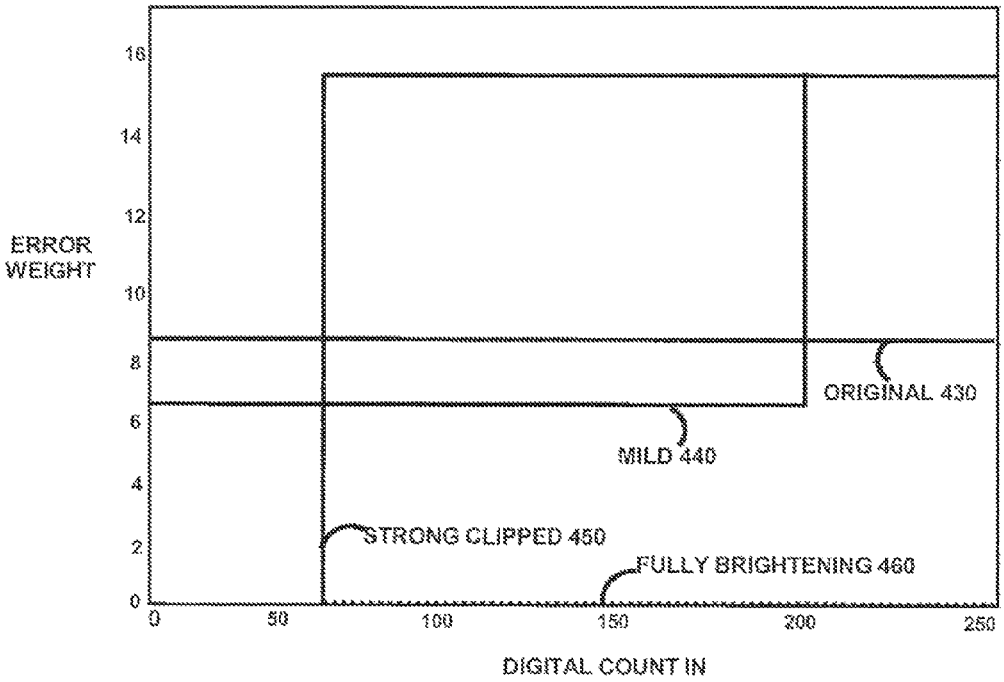
FIG. 6 illustrates error vectors.

The difference between the slope of each candidate tone curve and the slope of the full brightening tone curve is calculated for each input digital count. This difference is used to calculate an error vector for each tone curve. For example, the square of the error at each digital count may be used to produce FIG. 6. An error count curve 430 is shown for the original curve. An error count curve 440 is shown for the mild curve. An error count curve 450 is shown for the strongly clipped curve. An error count curve 460 is shown for the fully brightening curve.

A histogram of digital counts of the input image is computed and each error vector is used to compute a weighted sum, such as illustrated by equation 2.

$$\text{Weight}(i, x) = |FullBrighteningSlope(x) - CandidateSlope(i, x)|^{ErrorExponent} \qquad \text{Equation 2}$$

$$\text{Objective}(i) = \sum_x \text{Histogram}(x) \cdot \text{Weight}(i, x)$$

Figure 7:
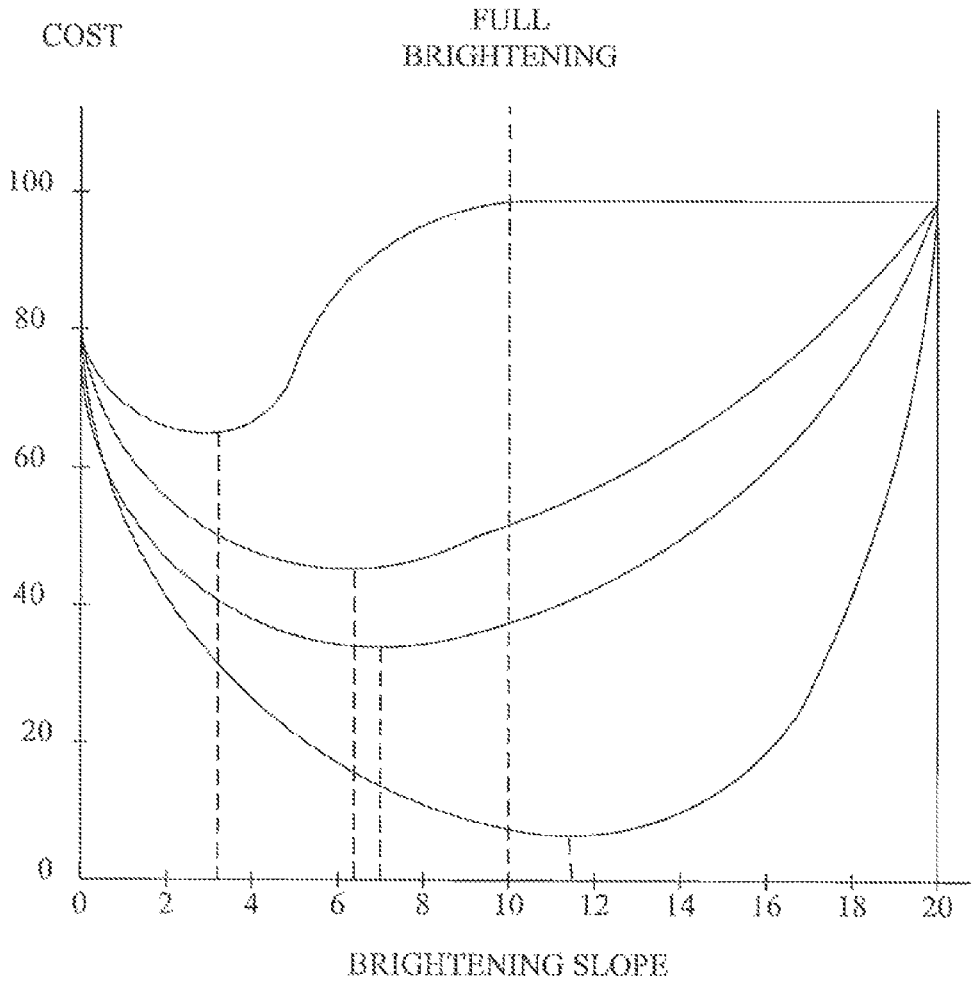
FIG. 7 illustrates optimal brightening selection.

This may be computed for a range of brightening slopes tracing out a curve defining an objective function for each brightening level. Sample objective functions for several input images are shown in FIG. 7, with the error levels of fully brightening illustrated and the more suitable brightening levels, namely the minimum error values, for the particular images (or set of images). Thus, the minimization of the brightness factor depends on both a brightening slope (hence ambient light level) and the image histogram. Once the brightening slope has be determined, a color preserving brightening process may be applied to produce the output image.

While this process selects a suitable brightness level and image content modification, the result for many images with aspects that are difficult to see. For example, thin edges for small parts are more difficult to discern or otherwise not readily observable. Thus a temporal edge based technique may be used to temporally align edge pixels with motion estimation and then smooth the edge pixel at the current frame with the support of its temporal correspondences to the other frames. This reduce temporal edge flickering and results in an improved viewing experience.

Referring to FIG. 7, an input image 100 is received and the grey luminance level (or color specific luminance levels) is determined 500. The gray image 500 is then processed to identify edges in the gray image, such as using a gradient estimate process 510. The gradient estimation process 510 may use a Guassian smoothing filter where the smoothing weight only depends on the temporal distance between the current frame and the previous (or future) frame(s). This smoothing may also be a bilateral smoothing filter where one weight depends on the temporal distance while the other weight depends on the gradient magnitude difference.

Pixels identified as being part of an edge are identified 520. At the identified edge pixel locations of the current image from the edge point process 520, the current gray image 530 and previous images 540, are temporally aligned 550. Referring also to FIG. 8, the temporal alignment 550 may be based upon any suitable motion estimation process, such as for example, a Lucas-Kanade optical flow. In order to smooth the edge pixel temporally, the system may find the corresponding pixel at previous frame for an edge pixel (i, j) at current frame. To achieve that, the edge pixels at current frame may be treated as features points to be tracked. Then pyramid Lucas-Kanade optical flow is invoked to calculate coordinates of the feature points on the previous frame given their edge pixel coordinates on the current frame. Note that the correspondence pixel at previous frame for an edge pixel (i, j) at current frame could be an edge pixel or non-edge pixel.

A temporal smoothing process 560 temporally smoothes the edge pixels based upon the current image gradient 570 and previous image gradients 580. The temporal smoothing may use an IIR filtering. At time t, the gradient magnitude of an edge pixel at (i, j,t) is a weighted combination of corresponding pixel at (i+u(i,j,Δt), j+v(i, j,Δt), t−Δt) of previous frame which have already been temporal smoothed. The result is a temporally smooth gradient image 590.

The temporal alignment process 550 reduces temporal edge flickering by temporally aligning the edge pixels, without the needs to temporally align the entire image. The temporal alignment of edge pixels may be treated as a sparse feature tracking technique where the edge pixels are the sparse features, and are tracked from time t to time t−1 with Lucas-Kanade optical flow. The sparse feature tracking dramatically increases the computational efficiency.

FIG. 8 illustrates the optical flow estimation in a 2-frame temporal window. Each edge pixel (i, j) in frame t may have 2 motion vectors $m_{i,j,\Delta t}$ with $\Delta t \in \{-2,-1\}$. Each motion vector $m_{i,j,\Delta t}$ may also have an associated temporal weight score $\rho_{i,j,\Delta t}$. Motion vectors may be computed with Lucas-Kanade optical flow, as illustrates in Equations 3, 4, and 5.

Equation 3

$$M = \begin{bmatrix} \sum_{n,m} w(n,m) f_x(n,m) f_x(n,m) & \sum_{n,m} w(n,m) f_x(n,m) f_y(n,m) \\ \sum_{n,m} w(n,m) f_x(n,m) f_x(n,m) & \sum_{n,m} w(n,m) f_y(n,m) f_y(n,m) \end{bmatrix}$$

Equation 4

$$b = \begin{bmatrix} -\sum_{n,m} w(n,m) f_x(n,m) f_t(n,m) \\ -\sum_{n,m} w(n,m) f_y(n,m) f_t(n,m) \end{bmatrix}$$

Equation 5

$$\begin{bmatrix} m^x_{i,j,\Delta t} \\ m^y_{i,j,\Delta t} \end{bmatrix} = M^{-1} b$$

Where $f_x(n, m)$ and $f_y(n, m)$ is the spatial gradient at pixels (n, m) in window $\Omega_{i,j}$. $f_t(n, m)$ is the temporal gradient at pixels (n, m). w(n, m) is data adaptive weight for pixels (n, m), it is computed as $$w(n,m) = \text{SIEVE}(|f(i,j) - f(n,m)|) \quad \text{Equation 6}$$

where SIEVE represents a Sieve filter.

The temporal smoothing of the edge pixels 560 may be based upon the temporal correspondences for edge pixel (i, j, t), which are used to perform temporal smoothing using the equation 7, 8, 9, and 10:

$$G(i, j, t) = \alpha G(i + m^x_{i,j,-2}, j + m^y_{i,j,-2} - 2) + \beta G(i + m^x_{i,j,-1}, j + m^y_{i,j,-1} - 1) \quad \text{Equation 7}$$

$$\alpha = \exp\left[-\frac{\text{ERROR}(i, j, t \to t-2)^2}{\sigma^2}\right] \quad \text{Equation 8}$$

$$\beta = \exp\left[-\frac{\text{ERROR}(i, j, t \to t-2)^2}{\sigma^2}\right] \quad \text{Equation 9}$$

$$\text{ERROR}(i, j, t \to t - \Delta t) = f(i, j, t) - f(i + m^x_{i,j,-2}, j + m^y_{i,j,-2}, t - \Delta t) \quad \text{Equation 10}$$

In equations 7-10, G(i,j,t) represents the gradient magnitude at position (i,j,t). The temporal filtering takes places in the gradient domain rather than the gray-scale domain. However, the motion vector may be found in the gray-scale domain.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method for modification of an image to be displayed on a display comprising:

(a) receiving an input image;

(b) selecting a brightening strength, for display of said input image, based upon an ambient lighting level and a visual system responsive model to the ambient lightening level that is based upon a relationship between a stimulus luminance, said ambient lighting level, and a reference light level; and (c) modifying said image according to said selected brightening strength.

2. The method of claim 1 wherein said brightening strength is based upon a signal received from an ambient sensor.

3. The method of claim 2 wherein said signal from said ambient sensor is temporally filtered.

4. The method of claim 2 wherein a peak brightening selection determines said brightening strength based upon a reference ambient value and said ambient lighting value.

5. The method of claim 4 wherein a weight construction is based upon a plurality of brightening candidates and said peak brightening selection.

6. The method of claim 5 wherein said brightening candidates are in the form of a look up table.

7. A method for modification of an image to be displayed on a display comprising:

(a) receiving an input image;

(b) selecting a brightening strength, for display of said input image, based upon an ambient lighting level and a visual system responsive model to the ambient lightening level;

(c) modifying said image according to said selected brightening strength;

(d) wherein said brightening strength is based upon a signal received from an ambient sensor;

(e) wherein a peak brightening selection determines said brightening strength based upon a reference ambient value and said ambient lighting value;

(f) wherein a weight construction is based upon a plurality of brightening candidates and said peak brightening selection;

(g) wherein said brightening candidates are in the form of a look up table;

(h) wherein said weight construction determines a set of errors.

8. The method of claim 7 wherein said set of errors is determined for each of said plurality of brightening candidates.

9. The method of claim 8 wherein a histogram is determined based upon said input image.

10. The method of claim 9 wherein said set of errors is applied to said histogram to determine a resulting error measure.

11. The method of claim 10 wherein the least resulting error measure is selected.

12. The method of claim 11 wherein a plurality of said least resulting error measures are temporally filtered.

13. The method of claim 11 wherein said resulting error measure is used to determine a tone scale.

14. The method of claim 13 wherein a brightness preservation modifies said input image based upon said tone scale.

15. A method for modification of an image to be displayed on a display comprising:

(a) receiving an input image;

(b) selecting a brightening strength, for display of said input image, based upon an ambient lighting level and a visual system responsive model to the ambient lightening level;

(c) modifying said image according to said selected brightening strength;

(d) wherein said input image for a series of images is further modified based upon a temporal alignment for edge pixels of said input image for the current frame, and temporally smoothing each of said edge pixels based upon said temporal alignment.

16. The method of claim 15 wherein said temporal alignment is based upon an optical flow.

17. The method of claim 15 wherein said temporal smoothing is based upon an infinite impulse response filter.

18. The method of claim 15 wherein said temporal alignment is not performed for a plurality of pixels not identified as edge pixels.

* * * * *